US007832063B2

(12) United States Patent
Yoshida

(10) Patent No.: US 7,832,063 B2
(45) Date of Patent: Nov. 16, 2010

(54) PAPER HOLDER

(75) Inventor: Tsukasa Yoshida, Saitama (JP)

(73) Assignee: NS Planning, Inc., Tokyo (JP)

( * ) Notice: Subject to any disclaimer, the term of this patent is extended or adjusted under 35 U.S.C. 154(b) by 123 days.

(21) Appl. No.: 12/095,641

(22) PCT Filed: Aug. 1, 2007

(86) PCT No.: PCT/JP2007/065052

§ 371 (c)(1),
(2), (4) Date: May 30, 2008

(87) PCT Pub. No.: WO2007/065052

PCT Pub. Date: Aug. 1, 2007

(65) Prior Publication Data

US 2008/0258452 A1 Oct. 23, 2008

(30) Foreign Application Priority Data

Feb. 6, 2007 (JP) ..... 2007-026946

(51) Int. Cl.
*B42F 1/02* (2006.01)

(52) U.S. Cl. ..... 24/67.3; 40/658; 211/45; 211/50; 24/499

(58) Field of Classification Search ..... 24/67.3, 24/489, 334, 499, 500, 311; 281/42, 43, 281/44, 45, 46, 47, 48, 49, 50, 51; 40/658, 40/611.12

See application file for complete search history.

(56) References Cited

U.S. PATENT DOCUMENTS

| | | | | |
|---|---|---|---|---|
| 4,506,416 | A * | 3/1985 | Ohminato et al. | 24/67 R |
| 6,842,951 | B1 * | 1/2005 | Barre et al. | 24/499 |
| 6,871,435 | B2 * | 3/2005 | Yoshida | 40/658 |
| 2003/0172570 | A1 | 9/2003 | Yoshida | |

FOREIGN PATENT DOCUMENTS

| | | | |
|---|---|---|---|
| JP | 2000-062370 | A | 2/2000 |
| JP | 2002-120482 | A | 4/2002 |
| JP | 3775222 | B2 | 3/2006 |

* cited by examiner

*Primary Examiner*—Victor Batson
*Assistant Examiner*—Michael Lee
(74) *Attorney, Agent, or Firm*—Sughrue Mion, PLLC

(57) ABSTRACT

A paper holder has a holding piece made of an elastic material such as synthetic rubber provided with a fixed portion in a flat-plate-like shape and a holding portion integrally formed with the fixed portion at a connection top portion having a joint portion with a long and thin cross section in a direction orthogonal to the insertion direction of papers. The papers are clipped between a holding end portion located on the other side of the connection top portion and a case by return force of the holding portion that rotates with the connection top portion as a fulcrum. An attached elastic auxiliary member adds the return force by regulating the movement of the holding portion.

3 Claims, 2 Drawing Sheets

PAPER HOLDER

TECHNICAL FIELD

The present invention relates to a paper holder used for clipping to fix a paper, a card, and other kinds of papers.

BACKGROUND ART

Conventionally, there have been various kinds of paper holders as the above type. Their basic structure has a configuration in which an opening for inserting papers is provided on one side of a case, and a holding member holding papers is provided within a case.

A card holder invented by the inventor has been disclosed in Patent Document 1. The above card holder is "a card holder having a configuration in which a card insertion slot is provided on one side by engaging a covering piece with one end portion of a base piece having a thick portion, and an elastic card clipping piece is installed in a space formed with the base piece and the covering piece on the covering piece in such a manner that one end of the card clipping piece abuts on the above-described base piece, characterized in that a part of the base portion engaging cards in a base piece is formed with a material softer than those of the other parts, the card clipping piece is made of an elastic material such as rubber, the cross section of an attachment portion to the covering piece is formed in a straight line, a foot piece is provided to protrude from the attachment portion, a clipping portion is provided by expanding from an end portion of the foot piece, and an end portion of the clipping portion has an inclination toward the card insertion slot to form a base piece abutment portion".

Patent Document 1: Japanese Patent No. 3775222

DISCLOSURE OF THE INVENTION

Problem to be Solved by the Invention

As the above-described card holder has an advantage that papers can be easily inserted and are hardly pulled out by reliably holding the papers, because a card clipping piece made of an elastic material such as rubber operates as a kind of a pendulum in the insertion direction of the papers (but does not move in the opposite direction) when inserting the papers.

However, there has been a tendency that it is difficult to structurally secure accuracy in the height direction of the card clipping piece when manufacturing because the cross sectional area of a joint portion between the clipping portion and an attaching portion is small and a clipping force of papers (force to press papers) is insufficient when the height of the card clipping piece is insufficient, also the clipping force tends to be decreased by shrinkage due to storage and repeated use.

The present invention has been made, considering the above-described circumstances, and an object of the present invention is to provide a paper holder in which, while making the best use of the advantages of the above-described card holder, variations in accuracy of a holding portion made of an elastic material can be corrected, there is no reduction in clipping force of papers by shrinkage of a holding portion due to storage and repeated use, and the inserted papers can be always clipped by an appropriate force.

Means for Solving Problem

The present invention has been made to realize the above-described object, and the invention according to claim 1 is a paper holder which has a holding piece made of an elastic material such as synthetic rubber provided with a fixed portion having a flat-plate-like shape along an insertion direction of papers, and a holding portion integrally formed with the fixed portion at a connection top portion having a joint portion with a long and thin cross section in a direction orthogonal to the insertion direction of the papers in the inside of a case, in which the holding portion moves in the paper insertion direction, with the connection top portion as a fulcrum when the papers are inserted, and which clips the papers between a holding end portion located on the other side of the connection top portion and a case by its return force, wherein there is attached an elastic auxiliary member for adding a return force by regulating the movement of the holding portion.

The invention according to claim 2 is the paper holder, wherein a plate-like elastic auxiliary member bent along the fixed portion and an inward inclination portion is attached in a region formed by the inner surface of the fixed portion and the inward inclination portion extending from the connection top portion to the holding end portion while inclined to the side of the insertion direction.

The invention according to claim 3 is the paper holder, wherein the connection top portion is provided with notch portions separated from the fixed portion at the both end portions in the width direction, the elastic auxiliary member is bent in the middle portion in the width direction, and the both end portions in the width direction are inserted into the notch portions of the connection top portion.

Effect of the Invention

According to the invention of claim 1, papers can be easily inserted and are hardly pulled out by reliably holding the papers, because the holding portion of the holding piece made of an elastic material such as rubber is operated in the paper insertion direction as a kind of a pendulum, with the connection top portion as a fulcrum when the papers are inserted, and the inserted papers are held between the holding end portion and the bottom portion of the case by the elastic and frictional force of the holding end portion. Since the elastic auxiliary member adding a return force by regulating the movement of the holding portion is attached, the elastic auxiliary member has a function to always keep the position of the holding portion in relation to the fixed portion at a predetermined position. Accordingly, when the accuracy in manufacturing the holding portion is insufficient and thus a holding force by the holding portion is insufficient, it can be corrected, and there is no reduction in paper holding force by shrinkage of the holding portion due to storage and repeated use, and the inserted papers can be always held by an appropriate force.

According to the invention of claim 2, the plate-like elastic auxiliary member bent along the fixed portion and the inward inclination portion is attached in a region formed by the inner surface of the fixed portion and the inward inclination portion extending from the connection top portion to the holding end portion while inclined to the side of the insertion direction. Thus, the plate-like elastic auxiliary member has a function by which the position of the holding portion in relation to the fixed portion is always kept at a predetermined position. Accordingly, when the holding force by the holding portion is insufficient, it is corrected, and there is no reduction in paper holding force caused by shrinkage of the holding portion due to storage and repeated use, and the inserted papers can be always held by an appropriate force. Moreover, the configuration of the elastic auxiliary member is simple, the manufacture thereof is easy, and thus the elastic auxiliary member is economical.

According to the invention of claim 3, the connection top portion is provided with the notch portions separated from the fixed portion at the both end portions in the width direction, the elastic auxiliary member is bent in the middle portion in the width direction, and the both end portions in the width direction are inserted into the notch portions of the connection top portion. Thus, the elastic auxiliary member can be simply and reliably fixed at an appropriate position to the holding portion for manufacturing, accordingly, addition of the holding force by the elastic auxiliary plate can be reliably stabilized.

DESCRIPTION OF REFERENCE NUMERALS

Figure 1:
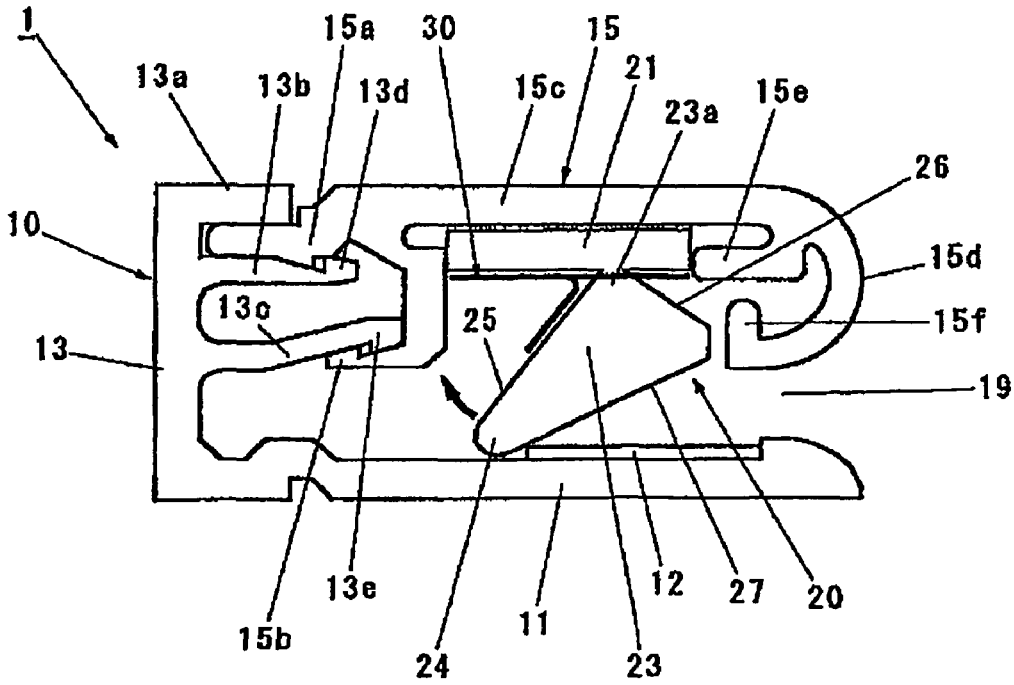
FIG. 1 is a side view of an embodiment of a paper holder 1.

1 paper holder
10 case
20 holding piece
21 fixed portion
23 holding portion
24 holding end portion
25 inward inclination portion
23*a* connection top portion
23*b* notch portions separated from the fixed portion
30 elastic auxiliary member

BEST MODE OF CARRYING OUT THE INVENTION

An embodiment of the present invention will be explained, referring to drawings, and the invention is not limited to the following embodiment, and various kinds of modifications, additions, and the like can be realized within a range of the gist of the present invention.

Embodiment

Figure 2:
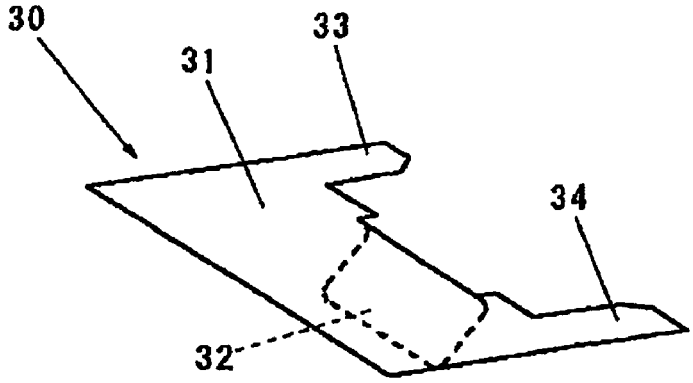
FIG. 2 is a perspective view of an elastic auxiliary member 30.
Figure 3:
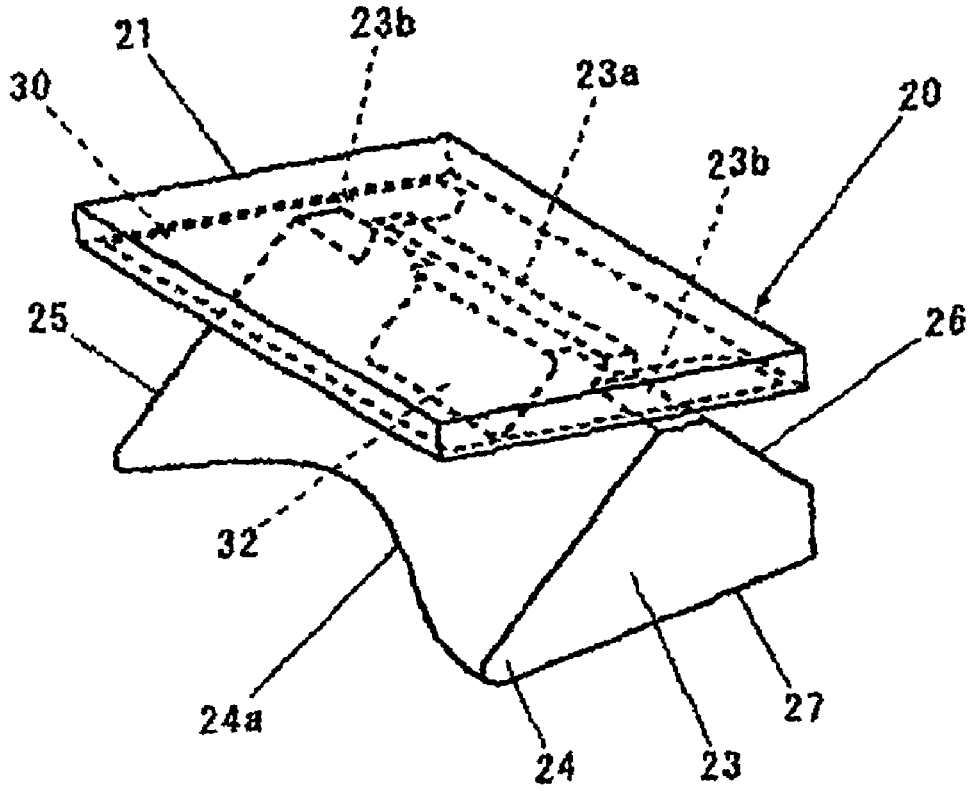
FIG. 3 is a perspective view of a state in which the elastic auxiliary member 30 is fixed to a holding portion 20.

FIG. 1 is a side view of a paper holder 1 according to an embodiment, FIG. 2 is a perspective view of an elastic auxiliary member 30, and FIG. 3 is a perspective view of a state in which the elastic auxiliary member 30 is fixed to a holding portion 20.

The paper holder 1 is provided with: a case 10; and a holding piece 20 installed in the case 10. The case 10 is provided with: a bottom portion 11; an upper covering portion 15 opposing to the bottom portion 11; an inserting slot 19 for papers, which is provided in a forward portion (the right side in FIG. 1) between the bottom portion 11 and the upper covering portion 15; and a rear wall portion 13 located in the other side of the inserting slot 19.

The case 10 is made of a hard synthetic resin material and the like, and is formed with a member including the bottom portion 11 and the rear wall portion 13 erecting from the rear end of the bottom portion 11 at approximately right angles, and the upper covering portion 15 engaged with the above-described member. Each of the portions is molded as a long product, and is formed by cutting the molded one in an appropriate length. Protruding pieces 13*b* and 13*c* which are protruding in a two-tiered manner are formed on the inner surface of the rear wall portion 13 while being slightly apart from an upper-end hook-like portion 13*a*. Engaging portions 15*a* and 15*b* which are formed in a two-tiered manner at the rear end portion of the upper covering portion 15 are engaged with engaging portions 13*d* and 13*e* provided at the tip portions of the protruding pieces 13*b* and 13*c*, respectively. The member including the bottom portion 11 and the rear wall portion 13 erecting from the rear end of the bottom portion 11 at approximately right angles, and the upper covering portion 15 are integrated as one body.

The cross section of the upper covering portion 15 is formed approximately in a J shape, and is provided with an attaching portion 15*c* which has a linear cross section, and is opposing to the bottom portion 11, and a front-end front portion 15*d* which has a cross section formed in a semicircular shape from the front end portion of the attaching portion 15*c*. A small protruding piece 15*e* which has a linear cross section and is provided for positioning of a fixed portion 21 of the holding piece 20 is protruding nearer to the front-end front portion 15*d* on the inner surface of the attaching portion 15*c*. Furthermore, a lower end portion 15*f* of the front-end front portion 15*d* is bent inward. The lower end portion 15*f* may function as a stopper by which the movement of the holding portion 23 to the forward side is stopped.

A sheet 12 made of rubber and the like is placed on the inner surface at the forward side of the bottom portion 11 of the case 10 in order to improve the clipping force for papers by increasing the frictional force.

The holding piece 20 is formed as an integrally molded product made of an elastic material such as synthetic rubber, is formed to have a lateral width so as to be stored in the case 10, and is attached to a space formed with the bottom portion 11 of the case 10 and the upper covering portion 15 opposing to the bottom portion 11.

The holding piece 20 is provided with the fixed portion 21 in a flat-plate-like shape along the insertion direction of papers which are inserted from the inserting slot 19, and the holding portion 23 which is integrally formed on a lower surface of the fixed portion 21 at a connection top portion 23*a* having a joint portion with a long and thin cross section in a direction orthogonal to the insertion direction of the papers (width direction). The upper surface of the fixed portion 21 is bonded to the inner surface of the attaching portion 15*c* in the case 10 with a double-faced tape and the like, and is fixed to the case 10. The size of the cross section of the joint portion between the fixed portion 21 and the connection top portion 23*a* is usually about 1 mm to 2 mm in depth, and about 10 mm to 20 mm in width. The connection top portion 23*a* is provided with notch portions 23*b* separated from the fixed portion 21 at both ends in the width direction.

The holding portion 23 in the holding piece 20 has a lateral (cross sectional) shape expanding downward with the connection top portion 23*a* as an upper corner portion, viewed from the lateral direction. At a lower end of the holding portion 23, there is formed a rounded holding end portion 24 which holds the papers by abutting on the bottom portion 11 of the case 10 or near the end portion on the side of the sheet insertion direction. The holding portion 23 has an inward inclination portion 25 extending from the connection top portion 23*a* to the holding end portion 24 while inclined to the side of the insertion direction, an outer upper-side portion 26 extending from the connection top portion 23*a* to the side of the inserting slot 19, and an outer lower-side portion 27 extending from a tip portion of the outer upper-side portion 26 to the holding end portion 24 while inclined to the side of the insertion direction. The cross section shape of the holding portion 23 is approximately triangular as a whole in the present embodiment.

A concave portion 24*a* which dents like an arc is formed in the holding end portion 24 except the both end portions in order to facilitate insertion and pulling-out of papers.

When the papers are inserted, the holding portion 23 in the holding piece 20 is rotated in the paper insertion direction, with the connection top portion 23*a* as a fulcrum, and the papers can be clipped between the holding end portion 24 located on the other side of the connection top portion 23*a* and the bottom portion 11 of the case 10 by its return force.

Then, the elastic auxiliary member 30, which regulates the movement of the above-described holding portion 23 to add a return force, is attached to the paper holder 1. The elastic auxiliary member 30 act on the holding portion 23 while contacting therewith, and is different from a member, which directly holds papers, in a point that the elastic auxiliary member 30 does not act while directly contacting with papers. The elastic auxiliary member 30 merely assists the action of the holding portion 23. Accordingly, the operating function of the elastic auxiliary member 30 is different from that of a conventional holding member which clips papers by a plate spring.

In the present embodiment, the plate-like elastic auxiliary member 30 that is bent along the fixed portion 21 and the inward inclination portion 25 is attached in a region formed by the inner surface of the fixed portion 21 in the holding piece 20 and the inward inclination portion 25 extending from the connection top portion 23*a* to the holding end portion 24 while inclined to the side of the insertion direction.

The elastic auxiliary member 30 is formed with a thin plate of a steel product, such as an SK material and a stainless steel, with a thickness of about 0.1 mm. The elastic auxiliary member 30 is provided with a base plate portion 31 along the inner surface of the fixed portion 21 in the holding piece 20, an inclination portion 32 bent along the inward inclination portion 25 in the middle portion of the base plate portion 31 in the width direction, and protruding portions 33 and 34 which are located at the both ends of the base plate portion 31 in the width direction and are extending from the base plate portion 31 to the side of the inserting slot as they are. The degree of adding return force by regulating the movement of the holding portion 23 of the elastic auxiliary member 30, in other words, a resistance force, namely, a spring force by the elastic auxiliary member 30 can be appropriately set by the thickness of the above-described thin plate, and the width and the length of the inclination portion 32.

Then, the above-described elastic auxiliary member 30 is fixed to the fixed portion 21 using an adhesive and the like in the base plate portion 31 along the inner surface of the fixed portion 21 of the holding piece 20, and at this time, the protruding portions 33 and 34 at the both ends the elastic auxiliary member 30 in the width direction are inserted into the notch portions 23*b* of the connection top portion 23*a* in the holding portion 23 to be fixed.

Then, when the papers are inserted from the inserting slot 19, the holding end portion 24 is pushed up by the inserted papers, and the holding portion 23 of the holding piece 20 is rotated in the paper insertion direction as a pendulum as shown by a arrow in FIG. 1, with the connection top portion 23*a* as a fulcrum. When the insertion and movement of the papers is stopped, the papers can be clipped by the return force of the holding portion 23, using the frictional force between the holding end portion 24 and the bottom portion 11 of the case 10. Though the elastic auxiliary member 30 regulates the movement of the holding portion to add the return force, the pendulum operation of the above-described holding portion 23 is not prevented, and is kept as it is. Therefore, the elastic auxiliary member 30 functions to always keep the position of the holding portion 23 in relation to the fixed portion 21 at a predetermined position. Accordingly, when the holding force by the holding portion 23 is insufficient, it is corrected, reduction in paper holding force caused by shrinkage of the holding portion 23 due to storage and repeated use can be prevented, and the inserted papers can be always held by an appropriate force.

When pulling out the papers, the frictional force between the holding end portion 24 and the bottom portion 11 of the case 10 generates resistance to the pulling-out to prevent the papers from carelessly being pulled out. When the papers are pulled out by a force larger than the frictional force, or are horizontally sled, the papers can be easily pulled out.

The invention claimed is:

1. A paper holder, comprising:

a holding piece made of an elastic material provided with:

a fixed portion having a flat-plate-like shape along an insertion direction of papers, and a holding portion integrally formed with the fixed portion at a connection top portion having a joint portion with a long and thin cross section in a direction orthogonal to the insertion direction of the papers in the inside of a case, wherein the holding portion moves in the paper insertion direction, the connection top portion is a fulcrum when the papers are inserted, and the papers are clipped between a holding end portion located on the other side of the connection top portion and a case by its return force, and an elastic auxiliary member that contacts and adds a return force to the holding portion, wherein the elastic auxiliary member does not contact with the papers, and the elastic auxiliary member does not prevent rotation of the holding portion about the fulcrum, wherein said elastic auxiliary member is plate-like and is bent along the fixed portion and an inward inclination portion and is attached in a region formed by an inner surface of the fixed portion and the inward inclination portion extending from the connection top portion to the holding end portion while inclined to a side of the insertion direction of the papers, wherein the connection top portion is provided with notch portions separated from the fixed portion at end portions of the connection top portion in the width direction of the connection top portion, the elastic auxiliary member is bent in the middle portion of the connection top portion in the width direction of the connection top portion, and both end portions of the elastic auxiliary member, in the width direction of the connection top portion, are inserted into the notch portions of the connection top portion.

2. The paper holder of claim 1, wherein a degree of spring force exerted by the elastic auxiliary member is determined based on a thickness of said elastic auxiliary member, and a width and thickness of an inclination portion of said elastic auxiliary member.

3. The paper holder of claim 1, wherein said elastic auxiliary member corrects an insufficient holding force generated by said holding portion.

* * * * *